United States Patent [19]

van Eerden

[11] Patent Number: 4,555,884

[45] Date of Patent: Dec. 3, 1985

[54] PLASTIC GLAZING PROFILE DESIGNED FOR GLAZING WINDOW-FRAMES

[75] Inventor: Piet van Eerden, Le Dedemsvaart, Netherlands

[73] Assignee: Wavin B.V., Zwolle, Netherlands

[21] Appl. No.: 576,887

[22] Filed: Feb. 3, 1984

Related U.S. Application Data

[63] Continuation of Ser. No. 328,020, Dec. 7, 1981.

[30] Foreign Application Priority Data

Sep. 12, 1980 [NL] Netherlands ..... 8006689

[51] Int. Cl.[4] ..... E04B 1/62

[52] U.S. Cl. ..... 52/397; 49/DIG. 1; 52/775; 52/400

[58] Field of Search ..... 52/397, 398, 399, 202, 52/775, 781, 764, 308, 400; 49/DIG. 1, DIG. 2

[56] References Cited

U.S. PATENT DOCUMENTS

| | | | |
|---|---|---|---|
| 3,487,601 | 1/1970 | James | 52/775 |
| 4,040,219 | 8/1977 | Badich | 52/209 |

FOREIGN PATENT DOCUMENTS

| | | | |
|---|---|---|---|
| 1111798 | 7/1961 | Fed. Rep. of Germany | 52/209 |
| 2556613 | 7/1976 | Fed. Rep. of Germany | 52/202 |
| 2537364 | 3/1977 | Fed. Rep. of Germany | 52/775 |
| 2810710 | 6/1979 | Fed. Rep. of Germany | 52/202 |
| 295266 | 7/1963 | Netherlands | 52/209 |
| 1222145 | 2/1971 | United Kingdom | 52/397 |
| 1406337 | 9/1975 | United Kingdom | 52/397 |

*Primary Examiner*—Henry E. Raduazo

*Attorney, Agent, or Firm*—Wilkinson, Mawhinney & Theibault

[57] ABSTRACT

A plastic glazing profile for mounting a glass pane in an existing wooden frame comprises a supporting face having at one end thereof an element for fixing a glass pane by means of projections. At its other end the profile comprises a glass pane abutment and opposite thereto a profile abutment edge. The profile abutment edge being the bottom of an abutment edge chamber, is provided with apertures forming outlets for water flowing from a gutter space through bores into said chamber. The profile abutment edge is able to engage a sealing strip through a projecting portion.

2 Claims, 1 Drawing Figure

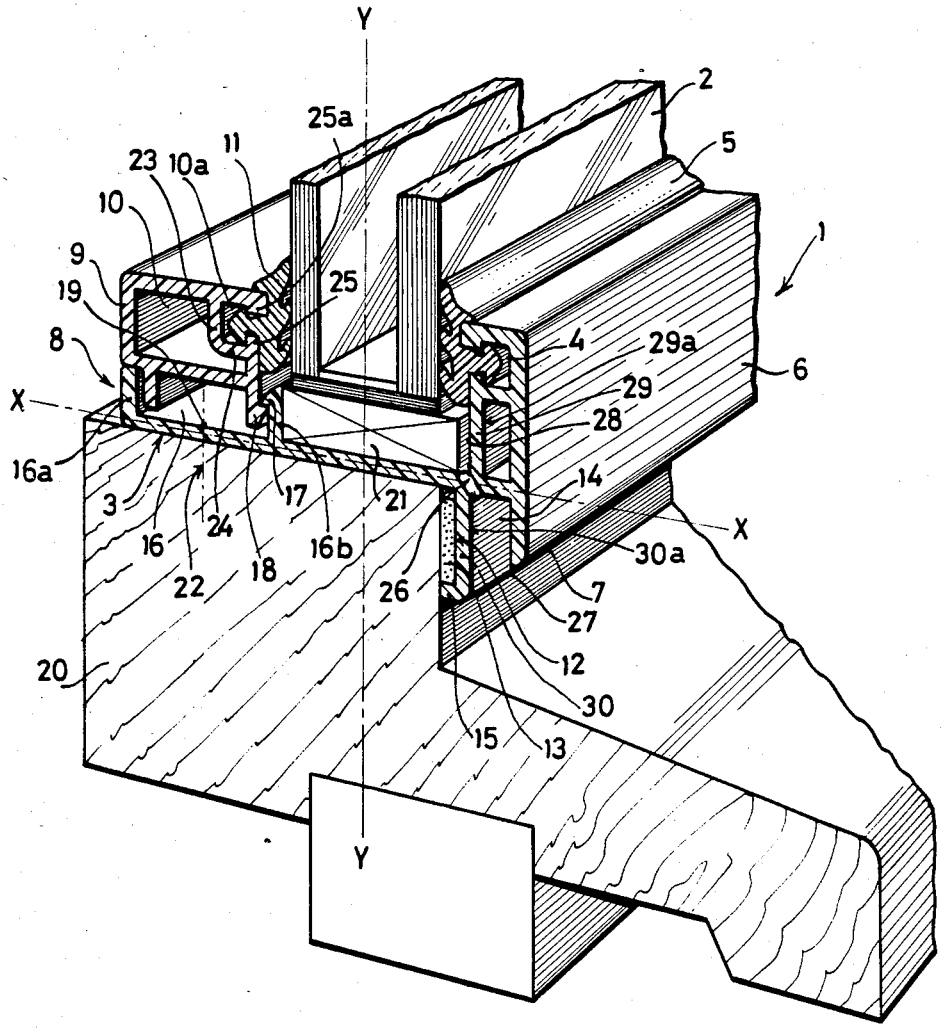
Y
2
5
1
25a
11
23
10a
10
9
19
8
25
4
29a
6
29
28
X
16a
3
17
21
14
X
16
24
16b
30a
22
18
26
7
27
12
20
30
15
13
Y

PLASTIC GLAZING PROFILE DESIGNED FOR GLAZING WINDOW-FRAMES

This application is a continuation of application Ser. No. 328,020, filed Dec. 7, 1981.

BACKGROUND OF THE INVENTION

1. Field of the Invention

The present invention relates to a plastic glazing profile designed for mounting a glass pane in an existing window-frame, preferably of the wooden window-frame type.

2. Description of the Prior Art

A plastic glazing profile for mounting a glass pane has been used in the art. The difficulty with the known profile is that its construction is inappropriate if double-walled glass panes are to be installed in existing houses, having wooden window-frames.

In the case of a renovation of existing edifices or houses, where it is desirable to change the entire construction of such buildings as little as possible and to maintain, for example, the existing wooden window-frames for the installment of new glass panes, so that a plastic profile for mounting a glass pane may be installed in the existing wooden window-frames.

SUMMARY OF THE INVENTION

It is a primary object of the present invention to provide a plastic glazing profile for mounting glass panes in window-frames of the aforementioned kind which may be installed rapidly and which does not have the hereinbefore noted objections.

These objectives are attained according to the invention by a plastic glazing profile for mounting a glass pane in a window frame, having a wooden window-frame. The profile has at least one horizontal supporting face, one end of the profile being provided at one side thereof with an upright glass-pane abutment having a cavity designed either to receive a sealing flap or having a sealing flap connected thereto, the other end of the profile has at the abutment side of the glass pane, an element for fitting a glass pane ledge. The plastic profile for mounting a glass pane presents its own inertia moments $I_x<8$ and $I_y<30$ cm$^4$, when the X-Y axes have been drawn through the center of gravity of the profile with X-azis parallel to the horizontal supporting face.

In this manner the profile is sufficiently flexible to easily be mounted in an existing wooden window-frame and in the case of a renovation, to rapidly provide an existing edifice or building with a double-glass pane.

More particularly, a plastic glazing profile for glazing window-frames according to the present invention offers an advantage in that the exterior of the wooden window-frame remains well accessible for painting.

The inertia moment $I_y$ very advantageously amounts to at most 20 cm$^4$ and more preferably, to 9 to 11 cm$^4$, while $I_x$ amounts to at most 5 cm$_4$ and, more preferably, to from 1 to 3 cm$^4$.

In a very favorable embodiment the horizontal supporting face of the plastic profile for glazing window-frames is single-walled, more particularly in order to obtain the desired inertia moment.

An important advantage of a plastic profile for glazing windows according to the present invention is that the glazing may be effected from the interior of the edifice or house in which said profile has been installed.

Another advantage of the profile according to this invention is that the profile has an opening for tightly securing same upon a wooden window-frame, more preferably between the projections for fixing a glass pane ledge.

Leakage water, if any, penetrating between a sealing flap of the profile and the mounted glass pane, will then fall into the gutter space, formed between the flange and the first projection. Openings connect the gutter space with a profile abutment edge chamber in the flange, the chamber in turn being connected to ambient, allows the leakage water to flow off without having to come into contact with the wood below the plastic profile.

More particularly, the plastic profile for mounting a glass pane according to the invention is suitable for mounting double-glass panes in existing window-frames, preferably wooden window-frames. The openings as mentioned hereinbefore also provide good ventilation of the space in which the glass panes are accommodated, thus ensuring a maximum life span of the double-glass.

The features of the present invention which are believed to be novel are set forth with particularity in the appended claims.

The advantages of the present invention will be more readily appreciated as they become better understood by reference to the following detailed description and considered in connection with the accompanying drawing in which like reference symbols designate like parts throughout the figures.

DESCRIPTION OF THE DRAWING

The single FIGURE of drawing is a fragmentary perspective view of the plastic glazing profile for mounting glass panes according to the invention, mounted upon a wooden lower frame having parts broken away and parts shown in section.

DESCRIPTION OF THE PREFERRED EMBODIMENT

In the drawing a plastic glazing profile 1 designed for mounting a glass pane 2 and adapted to retain the glass pane 2, has a horizontal supporting face 3, one end of the profile being provided at one side thereof with a double-walled upright glass pane abutment 6 having a cavity 4 designed to receive a sealing flap 5 which cooperates with said glass pane 2 to assist its retention in the profile.

It will be apparent that the plastic profile 1 may or may not be delivered together with said sealing flap.

In certain circumstances the cavity 4 may be replaced by a sealing flap 5 being co-extruded to the upright glass pane abutment 6.

Opposite the upright glass pane abutment 6 a profile abutment edge 7 is provided, being also double-walled and forming a profile abutment edge chamber 14.

By means of the projecting portion 15 the profile abutment edge 7 forms an outer cavity 12 for receiving a sealing strip 13. The profile abutment edge 7 is provided with square apertures 27.

The horizontal supporting face 3 of the profile is preferably single-walled.

At the other end of the profile a gutter-shaped cavity 16 having projections **16*a* and 16*b* is provided opposite the upright window-pane abutment 6. The cavity 16 forms an element 8 for fixing a glass pane ledge by lip 17 which extends from projection 16*b* and lip 18** which extends from the glass pane ledge profile.

After having installed a glass pane 2 a glass pane ledge 9 may be easily fitted by a snap action. The ledge 9 has a first channel 10 bounded by ledge parts 23 and 24 and a second channel 10*a*, designed to receive a second sealing flap 11 which serves to tightly retain the glass pane when the glass pane ledge 9 has been fitted. Channel 10*a* is provided with an upper and lower projecting edge 25 and 25*a* for retaining the sealing flap.

Water penetrating into the gutter space 28 below the glass pane 2 is allowed to flow through openings 26 into the abutment edge chamber 14 and through apertures 27 to the exterior. In order to improve water removal the inner surface 29*a* and 30*a* of the wall parts 29 and 30 of the profile are staggered with respect to each other.

The horizontal supporting face 3 has openings 19 which permit the plastic profile according to the invention to be secured upon a wooden-frame 20 by means of screws 22.

So as to easily install a glass pane 2 in a window-frame 20 supporting blocks 21 are preferably accommodated upon the horizontal supporting face 3.

The embodiment of the plastic profile for glazing window-frames as shown in the drawing, has a vertical inertia moment $I_y$ of 10.5 $cm^4$ and a horizontal inertia moment of $I_x$ of 2 $cm^4$; see the drawing for the X- and Y-axis.

Although the present invention has been shown and described in connection with a preferred embodiment thereof, it will be apparent to those skilled in the art that many variations and modifications may be made without departing from the invention in its broader aspects.

What is claimed is:

1. A plastic glazing profile for mounting a glass pane in a wooden window frame comprising a supporting surface adapted to be fixed to a wooden window frame, a first pair of inner- and outer-most spaced-apart flanges upstanding from said supporting surface, therewith forming an upright double wall glass pane abutment having a cavity adapted to accommodate a sealing flap, a second pair of spaced-apart flanges upstanding from said supporting surface on the side opposite said glass pane, a downwardly depending flange engagable with the window frame and being offset inwardly relative to said first innermost flange upstanding from said supporting surface, a duct-like element for fixing a glass plane edge positioned at the other side of said profile having at the abutment side of the glass a glass-sealing flap, said duct-like element having two downwardly depending flanges positioned for snap engagement with said second pair of spaced-apart flanges to anchor said glass pane to said supporting surface, said supporting surface having frame attachment openings therethrough, said plastic glazing profile having inertia moments $I_x$ lying within a range of from 1 to 8 and $I_y$ lying between 9 and 30 when viewed from an axis $I_y$ drawn through the center of gravity of the profile and wherein the $I_x$ axis is parallel to the horizontal supporting surface.

2. A plastic glazing profile as claimed in claim 1 wherein said downwardly depending flange is offset from said inwardly upstanding flange to permit drainage openings to be made from the glass compartment to the exterior.

* * * * *